US010422073B2

(12) United States Patent
Cinello

(10) Patent No.: US 10,422,073 B2
(45) Date of Patent: Sep. 24, 2019

(54) LAUNDRY WASHING MACHINE EQUIPPED WITH A TREATING AGENTS DISPENSER HAVING WATER SUPPLYING APPARATUS

(71) Applicant: Electrolux Appliances Aktiebolag, Stockholm (SE)

(72) Inventor: Mauro Cinello, Codroipo (IT)

(73) Assignee: Electrolux Appliances Aktiebolag (SE)

( * ) Notice: Subject to any disclaimer, the term of this patent is extended or adjusted under 35 U.S.C. 154(b) by 0 days.

(21) Appl. No.: 15/616,430

(22) Filed: Jun. 7, 2017

(65) Prior Publication Data

US 2018/0355543 A1 Dec. 13, 2018

(51) Int. Cl.

| | |
|---|---|
| ***D06F 39/02*** | (2006.01) |
| ***D06F 39/08*** | (2006.01) |
| ***D06F 39/00*** | (2006.01) |
| ***D06F 37/04*** | (2006.01) |

(52) U.S. Cl.

CPC ..... *D06F 39/028* (2013.01); *D06F 37/04* (2013.01); *D06F 39/005* (2013.01); *D06F 39/02* (2013.01); *D06F 39/022* (2013.01); *D06F 39/088* (2013.01)

(58) Field of Classification Search

CPC ..... D06F 39/028

See application file for complete search history.

(56) References Cited

U.S. PATENT DOCUMENTS

| | | | |
|---|---|---|---|
| 5,884,506 | A | 3/1999 | Blauert et al. |
| 2009/0119849 | A1 | 5/2009 | Hill et al. |
| 2012/0060568 | A1 | 3/2012 | Buso et al. |
| 2013/0180293 | A1 | 7/2013 | Huerth et al. |

FOREIGN PATENT DOCUMENTS

| | | | |
|---|---|---|---|
| DE | 102015114118 | A1 | 3/2017 |
| EP | 224169 | A1 | 10/2010 |
| EP | 2642014 | A1 | 9/2013 |
| KR | 20090089059 | A | 8/2009 |

OTHER PUBLICATIONS

International Search Report and Written Opinion for International Application No. PCT/EP2018/062590, dated Nov. 6, 2018—20 pages.

*Primary Examiner* — Jason Y Ko
(74) *Attorney, Agent, or Firm* — RatnerPrestia

(57) ABSTRACT

A laundry washing machine equipped with a treating agents dispenser includes a drawer having at least one open-top compartment and a water distributor arranged above the drawer. The water distributor includes at least one water conveying line for conveying water to a region of the water distributor positioned above the at least one compartment. The water conveying line comprises a first path which supplies with water one or more first outlets arranged in the region and a second path which supplies with water one or more second outlets suited to convey water to the tub/drum bypassing the at least one compartment. A common path portion is shared by the first path and the second path. In a second aspect, first and second water conveying lines extend from hot and cold water sources respectively, to a drawer compartment, without cross-linkage to other water distributor lines therebetween.

23 Claims, 14 Drawing Sheets

LAUNDRY WASHING MACHINE EQUIPPED WITH A TREATING AGENTS DISPENSER HAVING WATER SUPPLYING APPARATUS

BACKGROUND

The present invention concerns the field of laundry washing techniques. In particular, the present invention relates to a treating agents dispenser in a laundry washing machine.

Nowadays the use of laundry washing machines, both "simple" laundry washing machines (i.e. laundry washing machines which can only wash and rinse laundry) and laundry washing-drying machines (i.e. laundry washing machines which can also dry laundry), is widespread. In the present description the term "laundry washing machine" will refer to both a simple laundry washing machine and a laundry washing-drying machine.

Laundry washing machines generally comprise an external casing, or cabinet, provided with a washing tub which contains a rotatable perforated drum where the laundry is placed. A loading/unloading door ensures access to the drum.

Laundry washing machines typically comprise a treating agents dispenser for supplying with water and treating agents (i.e. detergent, softener, rinse conditioner, etc.) the tub. The treating agents dispenser is advantageously connected to a water source, typically a cold water source and/or a hot water source. Known treating agents dispensers comprise one or more compartments adapted to be filled with at least one treating agent and one or more respective water conveying lines for conveying water to the compartments. Water conveying lines are typically realized in a water distributor placed above the compartments. The water distributor is opportunely shaped to define ducts provided with apertures allowing water coming from the water source to fall in the underlying compartments.

Numerous efforts and attempts have been made by laundry washing machine manufacturers to find solutions that optimize the distribution of water in the compartments of the treating agents dispensers which equip the machines and/or that optimize construction of the treating agents dispenser itself. A drawback posed by water distributors of known type lies in that the water in the ducts flows at a high pressure, thus causing mechanical stresses for the water distributor components and/or increasing failures rate of the same.

SUMMARY OF SELECTED INVENTIVE ASPECTS

An object of the present invention is therefore to propose a laundry washing machine equipped with a treating agents dispenser comprising compartments for treating agents which guarantees a good distribution of water to the compartments.

Another object of the present invention is to propose a laundry washing machine equipped with a treating agents dispenser comprising compartments for treating agents which reduces manufacturing costs and/or time compared to known systems.

A further object of the present invention is to propose a laundry washing machine equipped with reduced mechanical stresses and/or failures rate compared to known systems.

The applicant has found that by providing a laundry washing machine equipped with a treating agents dispenser having at least one compartment receiving the treating agent and by providing a water conveying line that conveys both water to the compartment and water to the tub/drum bypassing the compartment, it is possible to achieve the mentioned objects.

In a first aspect thereof the present invention relates, therefore, to a laundry washing machine connectable to an external water source comprising a cabinet supporting a washing tub enclosing a rotatable washing drum suited to receive laundry and a treating agents dispenser connectable to the external water source and fluidly connected to the washing tub, the treating agents dispenser comprising:

- a drawer comprising at least one open-top compartment for receiving at least one agent for treating laundry;
- a supporting structure on which the drawer can slide so that it can be positioned in a closed position and an opened position;
- a water distributor arranged above the drawer, the water distributor comprising at least one water conveying line for conveying water from the external water source to a region of the water distributor which is positioned above the at least one compartment when the drawer is in its closed position;
  - wherein the at least one water conveying line comprises a first path which supplies with water one or more first outlets arranged in said region and a second path which supplies with water one or more second outlets suited to convey water to the tub/drum bypassing said at least one compartment.

The water distributor is preferably placed above the drawer in its working position, i.e. when the drawer is fully inserted into the supporting structure in the closed position.

The water distributor is preferably placed above the drawer in a fixed manner to maintain a fixed position with respect to the drawer.

Preferably, the water distributor is fixed to the supporting structure.

Advantageously, said at least one water conveying line is apt to convey water from the external water source to the region of the water distributor which is positioned above the at least one compartment and from said one or more first outlets to the underlying at least one compartment when the drawer is in its closed position.

Preferably, the first path diverges from the second path upstream of said one or more second outlets.

In a preferred embodiment of the invention, the first path comprises a curved portion.

Preferably, the curved portion is a dead-end portion. More preferably, the curved portion is spiral-shaped portion.

According to a preferred embodiment of the invention, the first outlets are homogenously arranged in the curved portion.

In a preferred embodiment of the invention, the second outlets are arranged above the drawer in such a way to be outside the at least one compartment.

Preferably, the second outlets are arranged above a water receiving seat associated to the housing.

According to a preferred embodiment of the invention, a pipe fluidly connects the water receiving seat to the tub.

In a preferred embodiment of the invention, the pipe terminates at the bellows of the door or at a surface of the tub.

Preferably, the external water source comprises a cold external water source.

According to a preferred embodiment of the invention, the at least one compartment receives a liquid bleach.

In a preferred embodiment of the invention, the machine further comprises a valve arranged between the external water source and the at least one water conveying line.

According to a further aspect, the applicant has found that by providing a laundry washing machine equipped with a treating agents dispenser having at least one compartment receiving the treating agent and by providing a water distributor that conveys both hot water and cold water to the same compartment, it is possible to achieve the mentioned objects.

In a further aspect thereof the present invention relates, therefore, to a laundry washing machine connectable to an external hot water source and to an external cold water source, the machine comprising a cabinet supporting a washing tub enclosing a rotatable washing drum suited to receive laundry and a treating agents dispenser connectable to the external water sources and fluidly connected to the washing tub, the treating agents dispenser comprising:

- a drawer comprising at least one open-top compartment for receiving at least one agent for treating laundry;
- a supporting structure on which the drawer can slide so that it can be positioned in a closed position and an opened position;
- a water distributor arranged above the drawer, wherein the water distributor comprises a first region which is positioned above the at least one compartment when the drawer is in its closed position and wherein the water distributor comprises a first water conveying line having at least one outlet arranged in the first region for conveying hot water from the external hot water source to the at least one outlet and then to the at least one compartment when the drawer is in its closed position and a second water conveying line having at least one opening arranged in the first region for conveying cold water from the external cold water source to the at least one opening and then to the at least one compartment when the drawer is in its closed position.

The water distributor is preferably placed above the drawer in its working position, i.e. when the drawer is fully inserted into the supporting structure in the closed position.

The water distributor is preferably placed above the drawer in a fixed manner to maintain a fixed position with respect to the drawer.

Preferably, the water distributor is fixed to the supporting structure.

According to a preferred embodiment of the invention, the machine comprises a first valve arranged between the external hot water source and the first water conveying line and a second valve arranged between the external cold water source and the second water conveying line.

Preferably, the first water conveying line comprises a water tight path fluidly connecting said first valve and said at least one outlet and/or the second water conveying line comprises a water tight path fluidly connecting said second valve and said at least one opening.

In a preferred embodiment of the invention, the at least one compartment is suited to receive a detergent for a main wash phase.

In a further preferred embodiment of the invention, the at least one compartment is suited to receive a unit dose package comprising a pre-measured amount of treating agent incorporated into a water-soluble pouch and wherein the water distributor comprises a further water conveying line having at least one nozzle arranged in the first region, the further water conveying line being suited for conveying hot or cold water from one of the external sources to the at least one nozzle for generating at least one water jet into the at least one compartment so that the at least one water jet is suited to hit the unit dose package and break the water-soluble pouch when the drawer is in its closed position.

According to a preferred embodiment of the invention, the machine comprises a valve arranged between the external hot or cold water source and the further water conveying line.

In a preferred embodiment of the invention, said at least one water jet is a laminar-flow water jet.

Preferably, the further water conveying line comprises a water tight path fluidly connecting said valve and said at least one nozzle.

According to a preferred embodiment of the invention, the at least one compartment further comprises a stopping device adapted for stopping the unit dose package in a predefined zone inside the at least one compartment.

Preferably, the stopping device is suited to stop the unit dose package when the unit dose package is intact while it is configured to allow the passage of treating agent released from the unit dose package after breakage of the water-soluble pouch.

BRIEF DESCRIPTION OF THE DRAWINGS

Further characteristics and advantages of the present invention will be highlighted in greater detail in the following detailed description of a preferred embodiment of the invention, provided with reference to the enclosed drawings. In the drawings, corresponding characteristics and/or components are identified by the same reference numbers. In such drawings.

DETAILED DESCRIPTION OF EXAMPLE EMBODIMENTS

Figure 2:
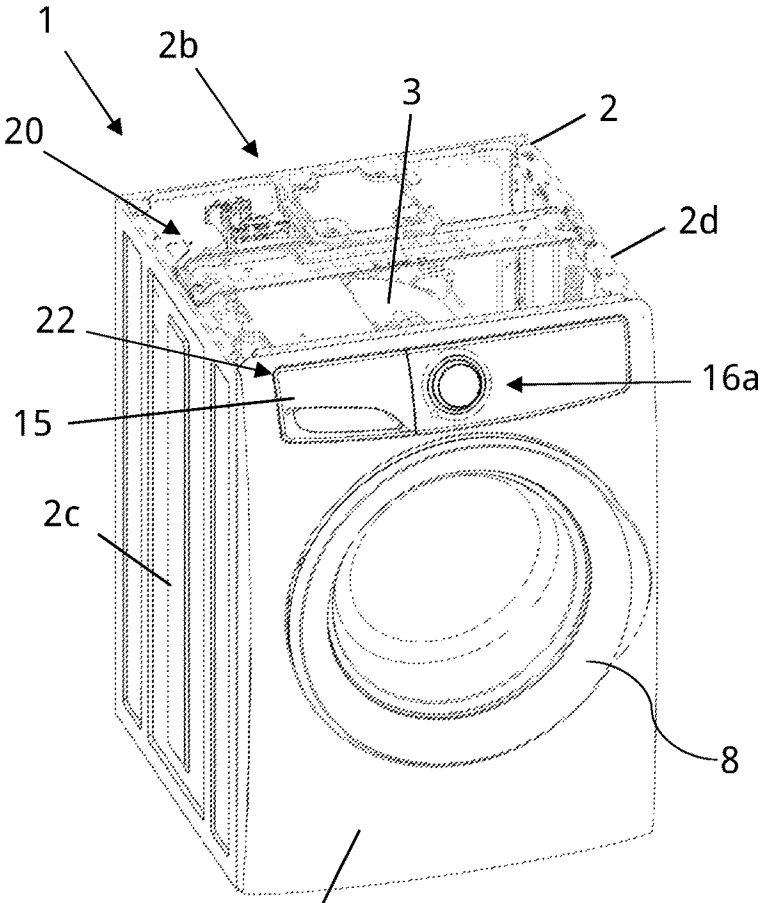
FIG. 2 shows the laundry washing machine of FIG. 1 with the upper side wall removed.

The present invention has proved to be particularly advantageous when applied to laundry washing machines, as described below. It should in any case be underlined that the present invention is not limited to laundry washing machines. On the contrary, the present invention can be conveniently applied to laundry washing-drying machines (i.e. laundry washing machines which can also dry laundry).

In the present description, therefore, the term "laundry washing machine" will refer to both a simple laundry washing machine and a laundry washing-drying machine.

A laundry washing machine 1 equipped with a treating agents dispenser 20 according to a preferred embodiment of the invention is described with reference to FIGS. 1 to 14.

The laundry washing machine 1 comprises an external casing or cabinet 2 in which a washing tub 3 is provided that contains a perforated washing drum, not shown, where the laundry to be treated can be loaded. The cabinet 2 comprises a vertical front side wall 2*a*, a vertical rear side wall 2*b*, two vertical lateral side walls 2*c*, 2*d* and an upper side wall 2*e*.

The cabinet 2 is provided with a loading/unloading door 8 which allows access to the drum.

The tub 3 is preferably suspended in a floating manner inside the cabinet 2, advantageously by means of a number of coil springs and shock-absorbers (not shown).

The drum is advantageously rotated by an electric motor (not shown) which preferably transmits the rotating motion to the shaft of the drum, advantageously by means of a belt/pulley system (not shown). In a different embodiment of the invention, the motor can be directly associated with the shaft of the drum.

The drum is advantageously provided with holes which allow the liquid flowing therethrough. Said holes are typically and preferably homogeneously distributed on the cylindrical side wall of the drum.

Laundry washing machine 1 advantageously comprises a control unit (not shown), connected to the various parts of the laundry washing machine 1 to ensure its operation. Laundry washing machine 1 preferably comprises an interface unit 16, connected to the control unit, accessible to the user and by means of which the user may select and set the washing parameters, like for example a desired washing cycle. Usually, other parameters can optionally be inserted by the user, for example the washing temperature, the spinning speed, etc. The interface unit 16 preferably comprises a display which displays machine working conditions.

The unit interface 16 then preferably comprises one or more selector devices which allow to select the appropriate washing cycle and/or to set other parameters.

For example, the selector devices may comprise a rotary knob 16*a* which advantageously allows to select the appropriate washing cycle. The selector devices may then preferably comprise push buttons.

The laundry washing machine 1 advantageously comprises said treating agents dispenser 20 to supply treating agents into the tub 3 during a washing cycle. Treating agents may comprise, for example, detergents, rinse additives, fabric softeners or fabric conditioners, waterproofing agents, fabric enhancers, rinse sanitization additives, bleach, chlorine-based additives, etc.

Advantageously, the treating agents dispenser 20 comprises a supporting structure 21, connected to the cabinet 2, internally to the latter, preferably by suitable fixing means, comprising, for example, screws or rivets, not illustrated, or also glue, or welding.

Figure 7:
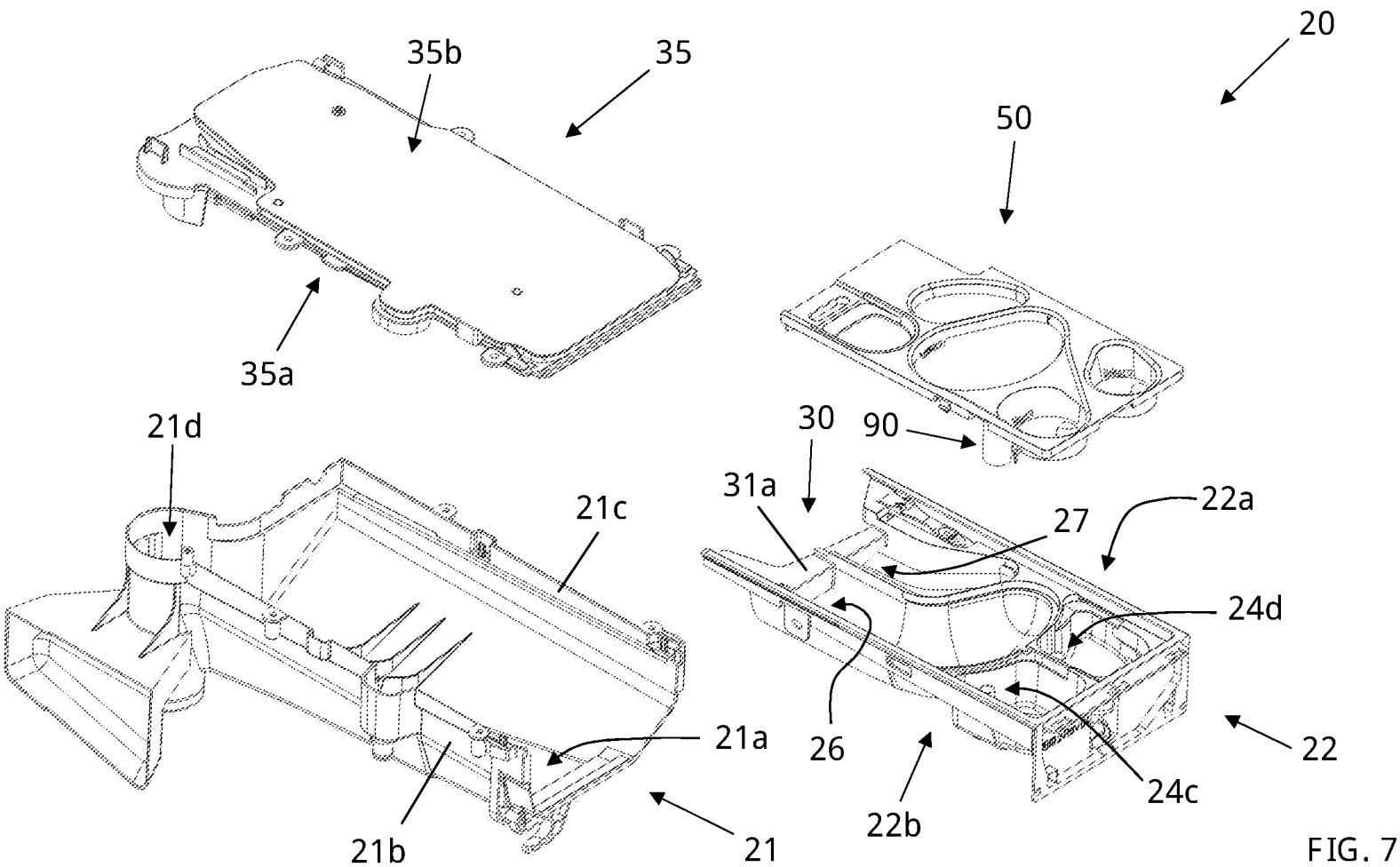
FIG. 7 shows an exploded view of the treating agents dispenser of FIG. 5 with some components removed therefrom.
Figure 8:
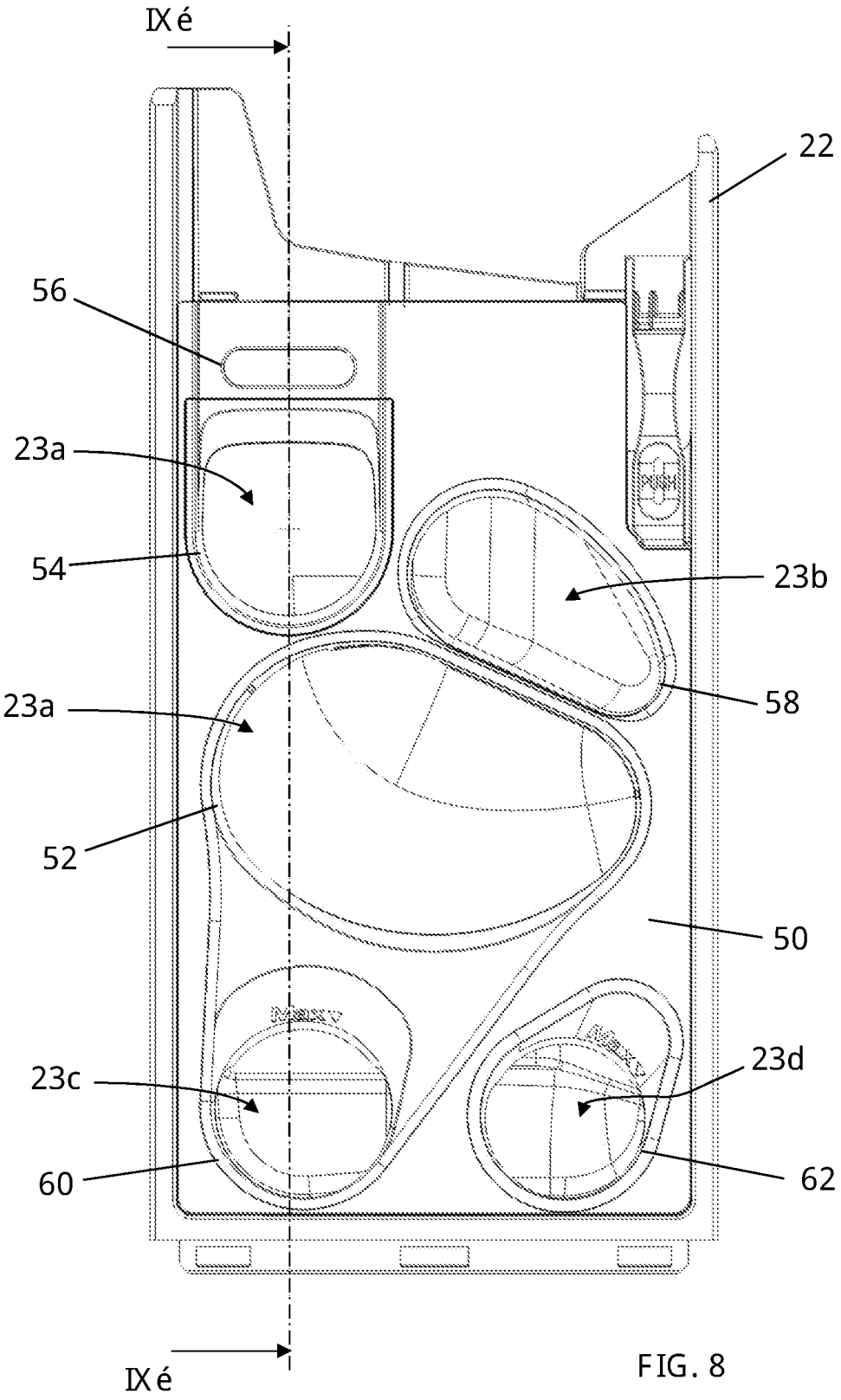
FIG. 8 is a plan top view of some elements of FIG. 7 in an assembled configuration.
Figure 9:
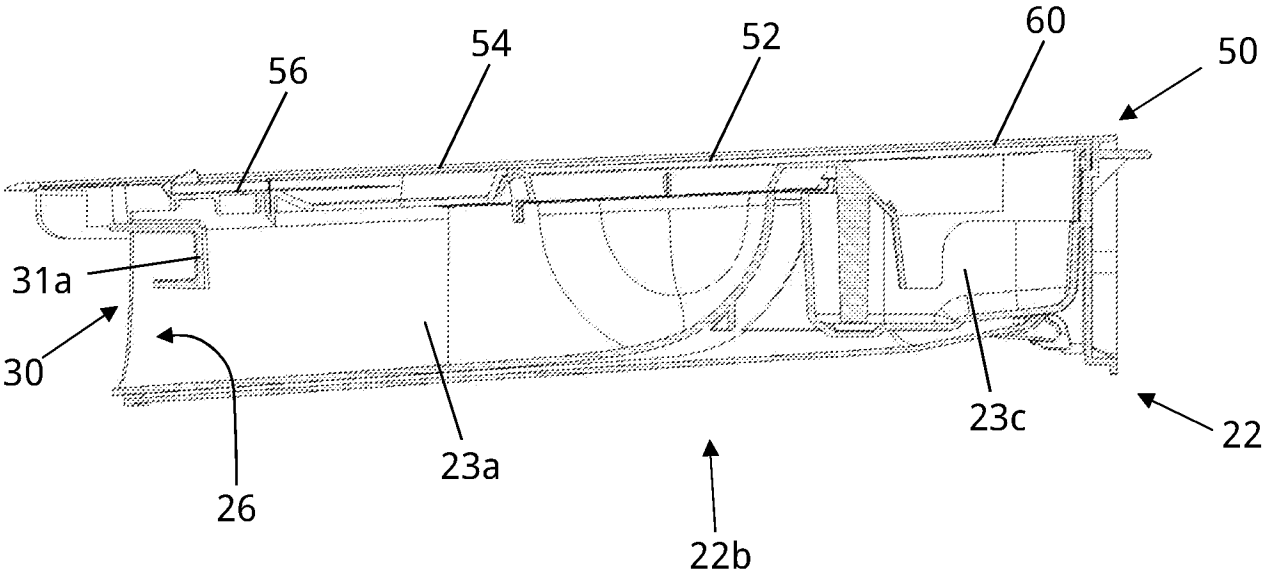
FIG. 9 is a plan sectional view taken along line IX-IX of FIG. 8.
Figure 10:
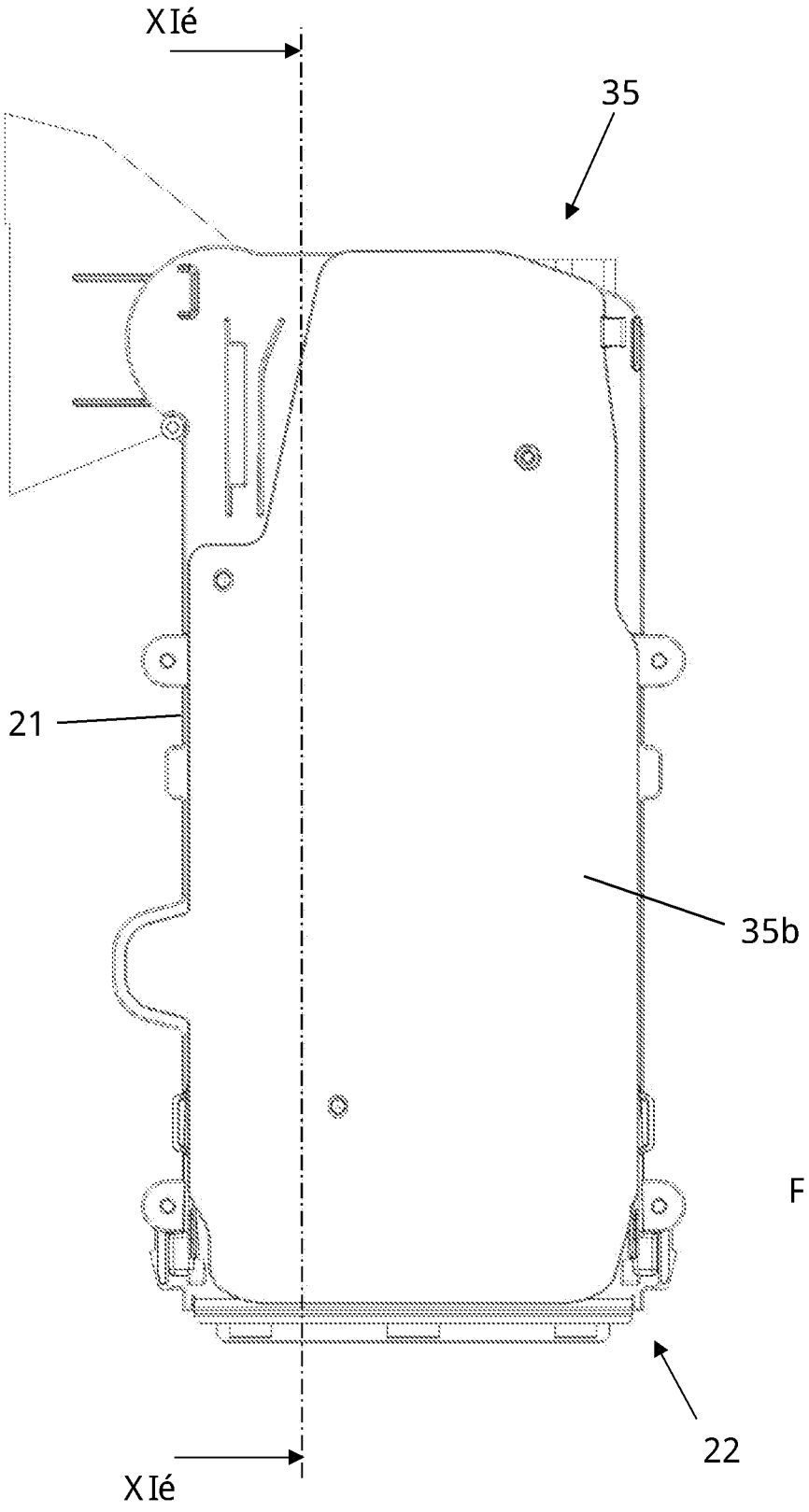
FIG. 10 is a plan view of the treating agents dispenser of FIG. 5 with the drawer in its closed position and some components removed therefrom.
Figure 11:
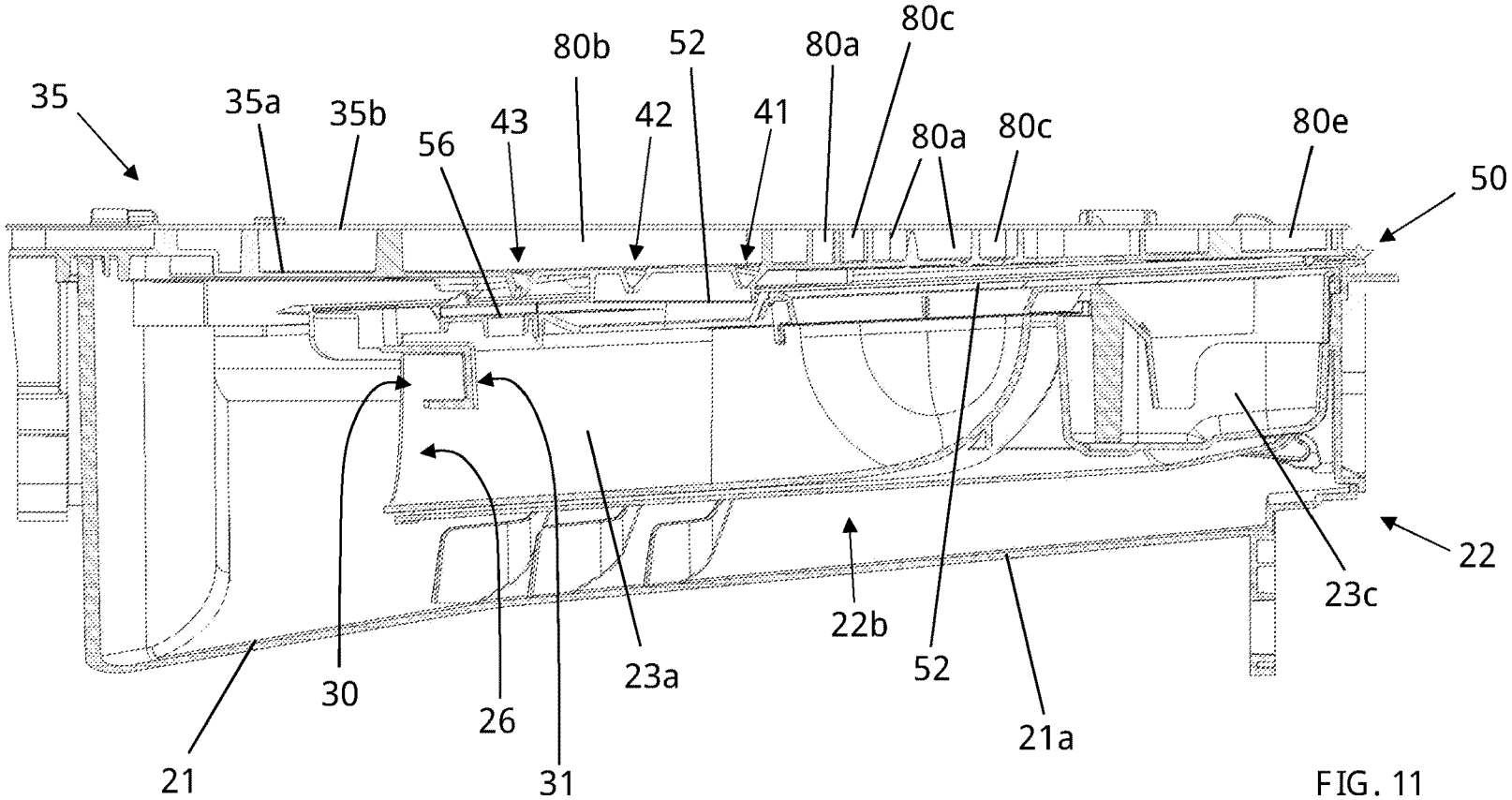
FIG. 11 is a plan sectional view taken along line XI-XI of FIG. 10.

Preferably, the supporting structure 21 comprises a housing, more preferably a box-shaped housing 21, as illustrated in FIG. 7.

In the enclosed Figures, the housing 21 is advantageously substantially parallelepiped and it is connected to the frontal side wall 2*a* of the cabinet 2, opportunely in an upper region of the latter, positioned above the tub 3.

The housing 21 preferably comprises a bottom side wall 21*a* and lateral vertical side walls 21*b*, 21*c*, as visible in FIG. 7.

An outlet port 21*d* is preferably defined at the rear portion of the bottom side wall 21*a*. The outlet port 21*d* is adapted to allow the flowing of a liquid into a supply pipe (not shown) fluidly connecting the treating agents dispenser 20 to the washing tub 3.

Figure 1:
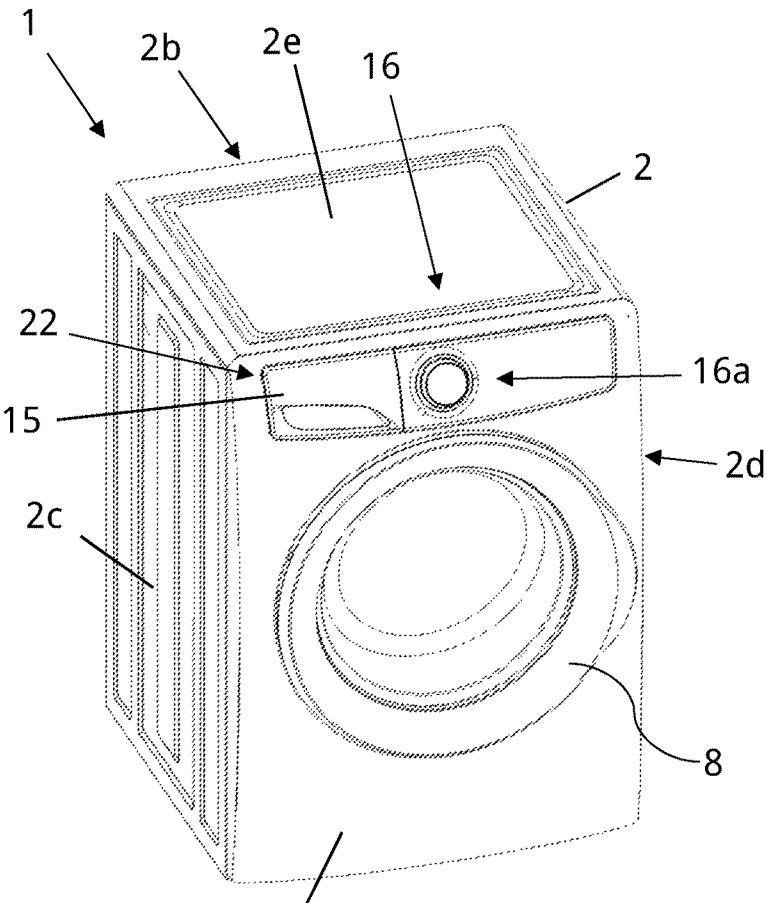
FIG. 1 shows a perspective view of a laundry washing machine equipped with a treating agents dispenser according to a preferred embodiment of the invention.
Figure 3:
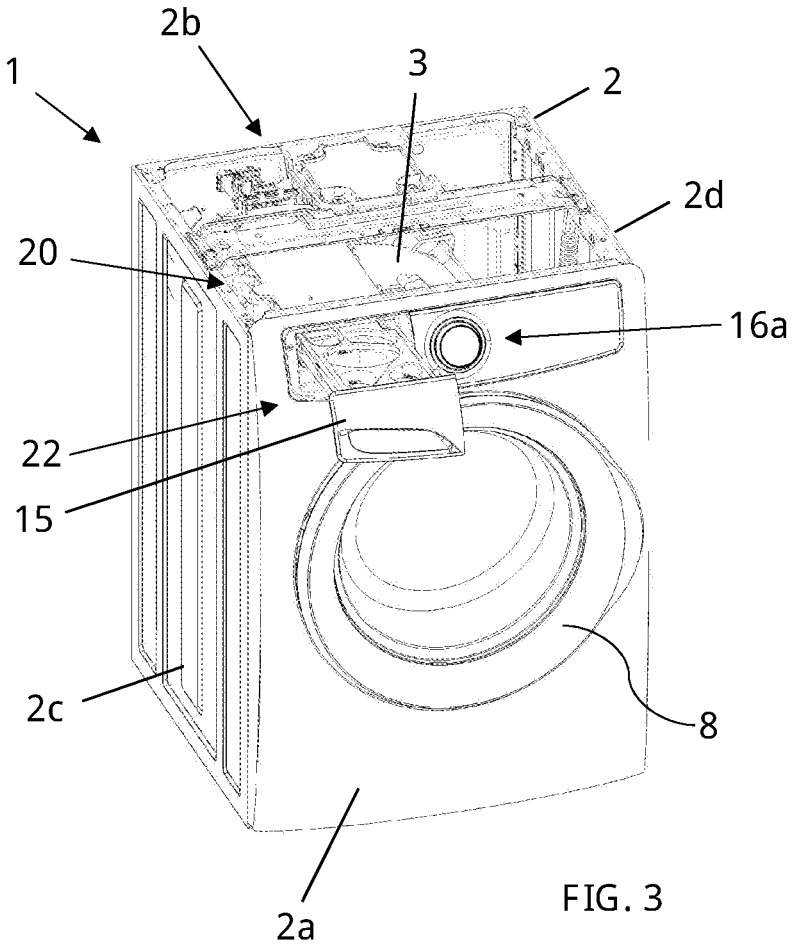
FIG. 3 shows the laundry washing machine of FIG. 2 with the drawer of the treating agents dispenser in its opened position.
Figure 4:
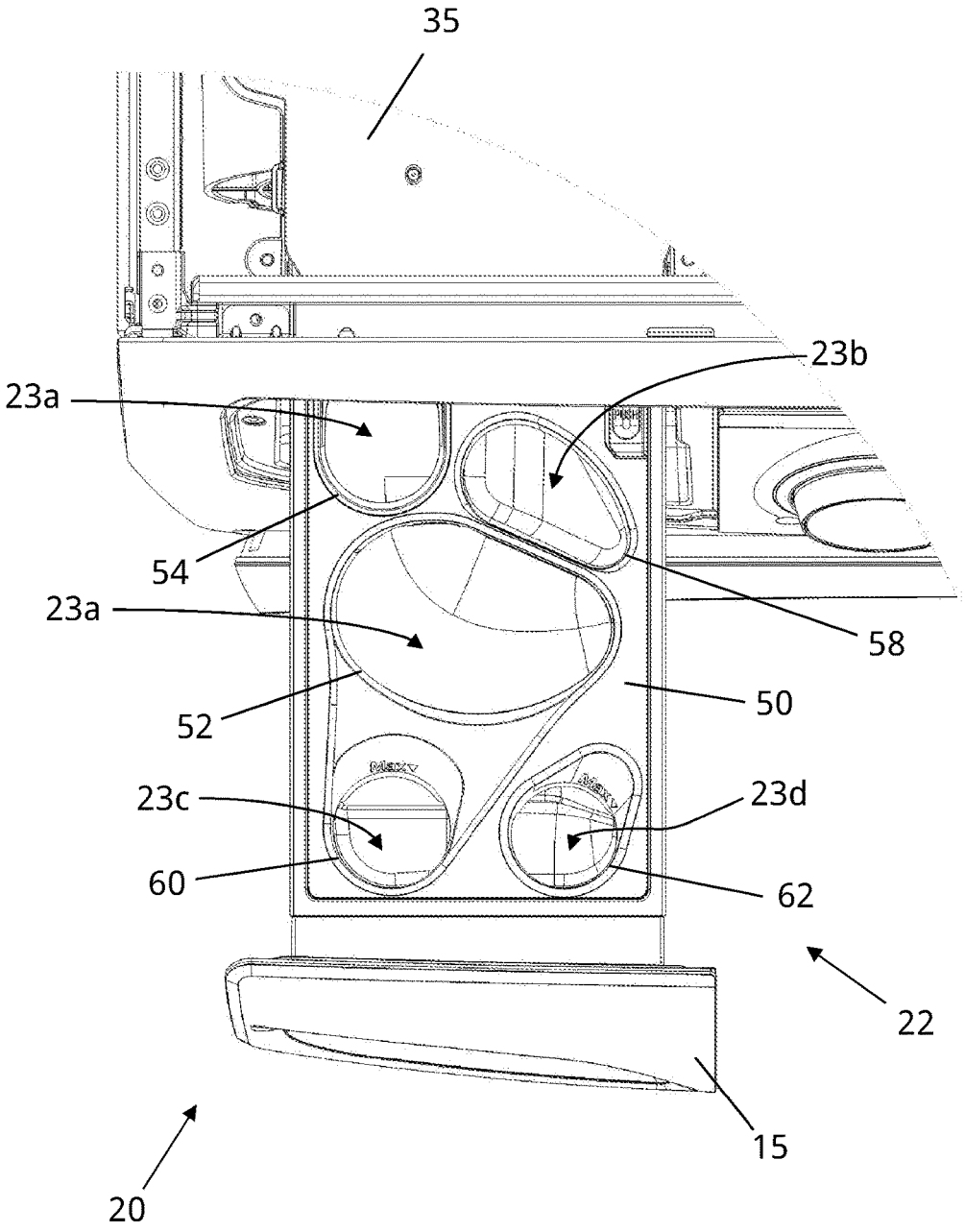
FIG. 4 shows an enlarged plan view, from above, of a detail of FIG. 3.

The housing 21 is suited to receive a drawer 22, preferably a slidable drawer 22, which can be extracted from the housing 21, such as to protrude from the cabinet 2 in an opened position, as illustrated for example in FIGS. 3 and 4, or can be fully inserted into the housing 21 in a closed position, as illustrated in FIGS. 1 and 2.

The drawer 22 preferably comprises a front panel 15 associated to a frontal part of the drawer 22 and preferably has a handle by means of which the drawer 22 can be moved from the closed position to an opened position and, vice-versa, can be moved from the opened position to the closed position.

For sake of simplicity in some figures the front panel 15 is removed.

The drawer 22 preferably comprises an upper side 22*a* and an opposite underside 22*b*, as illustrated in FIG. 7.

The drawer 22 is preferably provided with one or more compartments 23*a*, 23*b*, 23*c*, 23*d* adapted to be filled with treating agents.

The compartments 23*a*, 23*b*, 23*c*, 23*d* are preferably opened upwardly, i.e. open-top, to allow filling with treating agents from above.

In the embodiment illustrated in the Figures, there are four compartments, 23*a*, 23*b*, 23*c* and 23*d*.

In different embodiments, not illustrated, the number of compartments may be different, according to the desired type and number of treating agents which are used in the particular model of laundry washing machine.

The first compartment 23*a* of the drawer 22 is fluidly connected to the bottom 21*a* of the housing 21 through an aperture 26 defined at the rear of the first compartment 23*a*.

The second compartment 23*b* of the drawer 22 is fluidly connected to the bottom 21*a* of the housing 21 through an aperture 27 defined at the rear of the second compartment 23*b*.

The first compartment 23*a* is preferably adapted for receiving a powder detergent and/or a unit dose package, which is preferably used during a main wash phase of the selected washing cycle.

A washing cycle usually comprises a washing phase comprising a laundry wetting phase with addition of water and detergent followed by treatment of the laundry by means of solution of water and detergent. The water is typically heated to a predetermined temperature based on the washing cycle selected by the user. In a further preferred embodiment, hot water for the main wash phase is introduced from an external hot water source. During the main wash phase the drum is rotated, so as to apply also a mechanical cleaning action on the laundry. At the end of the main wash phase the drum is typically rotated at high rotational speed, in such a way that dirty washing liquid (i.e. water mixed with detergent) is extracted from the laundry. The dirty washing liquid is drained to the outside by a water draining device.

A successive step of the cycle typically comprises a rinsing phase which usually comprises one or more rinsing cycles.

With the term "unit dose package" it is meant a pre-measured amount of treating agent incorporated into a water-soluble pouch, wherein the treating agent preferably includes detergent. Hereinafter we will indicate said unit dose package simply with the term "pod".

The first compartment 23*a* preferably comprises a stopping device 30.

The stopping device 30 is adapted for stopping the pod and preventing it reaching the rear aperture 26 of the first compartment 23*a*. The stopping device 30 is preferably adapted for stopping the pod in a predefined zone inside the first compartment 23*a*.

In the embodiment illustrated, the stopping device 30 preferably comprises a horizontal rib 31*a* arranged rearwardly in the first compartment 23*a*.

In different embodiments, not illustrated, the stopping device may be differently realized.

In a particular case, the compartment itself may be properly shaped so that it accomplishes the function of stopping the detergent pod inserted therein.

The second compartment 23*b* is preferably adapted for receiving a quantity of a powder stain remover which is preferably used during a proper phase of the selected washing cycle; the third compartment 23*c* is preferably adapted for receiving a liquid sanitization additive, for example bleach, which is preferably used during a proper phase of the selected washing cycle; the fourth compartment 23*d* is preferably adapted for receiving a liquid softener, which is preferably used during a proper phase of the selected washing cycle.

The second and third compartments 23*c* and 23*d* are preferably provided with respective siphon tubes 24*c* and 24*d*, as illustrated in FIG. 7.

The first siphon tube 24*c* fluidly connects the third compartment 23*c* to the underside 22*b* of the drawer 22 and the second siphon tube 24*d* fluidly connects the fourth compartment 23*d* to the underside 22*b* of the drawer 22.

In different embodiments, other treating agents may be used, such as fabric conditioners, waterproofing agents, fabric enhancers, chlorine-based additives, etc.

The treating agents dispenser 20 further preferably comprises a water distributor 35 associated to the housing 21 and placed above the drawer 22.

The water distributor 35 is preferably placed above the drawer 22 in its working position, i.e. when the drawer 22 is fully inserted into the housing 21 in the closed position.

The water distributor 35 is preferably placed above the drawer 22 in a fixed manner to maintain a fixed position with respect to the drawer 22, i.e. it does not slide together with the drawer 22. In the preferred embodiment illustrated herewith, the water distributor 35 is fixed to the housing 21, more preferably upperly fixed to lateral vertical side walls 21*b*, 21*c* of the housing 21.

In different preferred embodiments, the water distributor may be fixed to other parts of the laundry washing machine 1, for example to the casing 2.

The treating agents dispenser 20 further preferably comprises a cover element 50 which is arranged between the drawer 22 and the water distributor 35.

The cover element 50 preferably follows the drawer 22 during its movement and preferably slides therewith.

The cover element 50 is then preferably removable arranged on the drawer 22.

The water distributor 35 is configured in such a way to allow the flowing of water to one or more of said compartments 23*a*, 23*b*, 23*c*, 23*d* when the drawer 22 is placed in its closed position.

At this purpose, the water distributor 35 preferably comprises one or more water conveying lines 80*a*, 80*b*, 80*c*, 80*d*, 80*e*, 80*f* adapted for selectively conveying water to one or more of said compartments 23*a*, 23*b*, 23*c*, 23*d* of the drawer 22 when the latter is placed in its closed position, as better described below.

The water distributor 35 preferably comprises a lower part 35*a* and an upper closing part 35*b* structured for being reciprocally coupled to form the water distributor 35. The two parts 35*a*, 35*b* are preferably coupled by welding and/or glueing and/or joint.

Water conveying lines 80*a*, 80*b*, 80*c*, 80*d*, 80*e*, 80*f* are provided with outlets/openings 82*a*, 82*b*, 82*c*, 82*d*, 82*e*, 82*f* arranged on the underside 35*a* of the distributor 35 and facing the underlying compartments 23*a*, 23*b*, 23*c*, 23*d*. Outlets/openings 82*a*, 82*b*, 82*c*, 82*d*, 82*e*, 82*f* allow the passage of the water from the water distributor 35 to the underlying compartments 23*a*, 23*b*, 23*c*, 23*d*.

The cover element 50 preferably comprises apertures 52, 54, 56, 58, 60, 62 which are arranged above the compartments 23*a*, 23*b*, 23*c* and 23*d*.

In the preferred embodiment here illustrated, there are six apertures 52, 54, 56, 58, 60, 62.

In different embodiments, the number of apertures may be different, according to the desired type and number of treating agents which are used in the particular model of laundry washing machine.

In the preferred embodiment here illustrated, first, second and third apertures 52, 54, 56 are positioned above the first compartment 23*a*, the fourth aperture 58 is positioned above the second compartment 23*b*, the fifth aperture 60 is positioned above the third compartment 23*c* and the sixth aperture 62 is positioned above the fourth compartment 23*d*.

Preferably, the first aperture 52 is preferably used to introduce powder detergent in the first compartment 23*a*. The second aperture 54 is preferably used to introduce a pod in the first compartment 23*a*.

Figure 5:
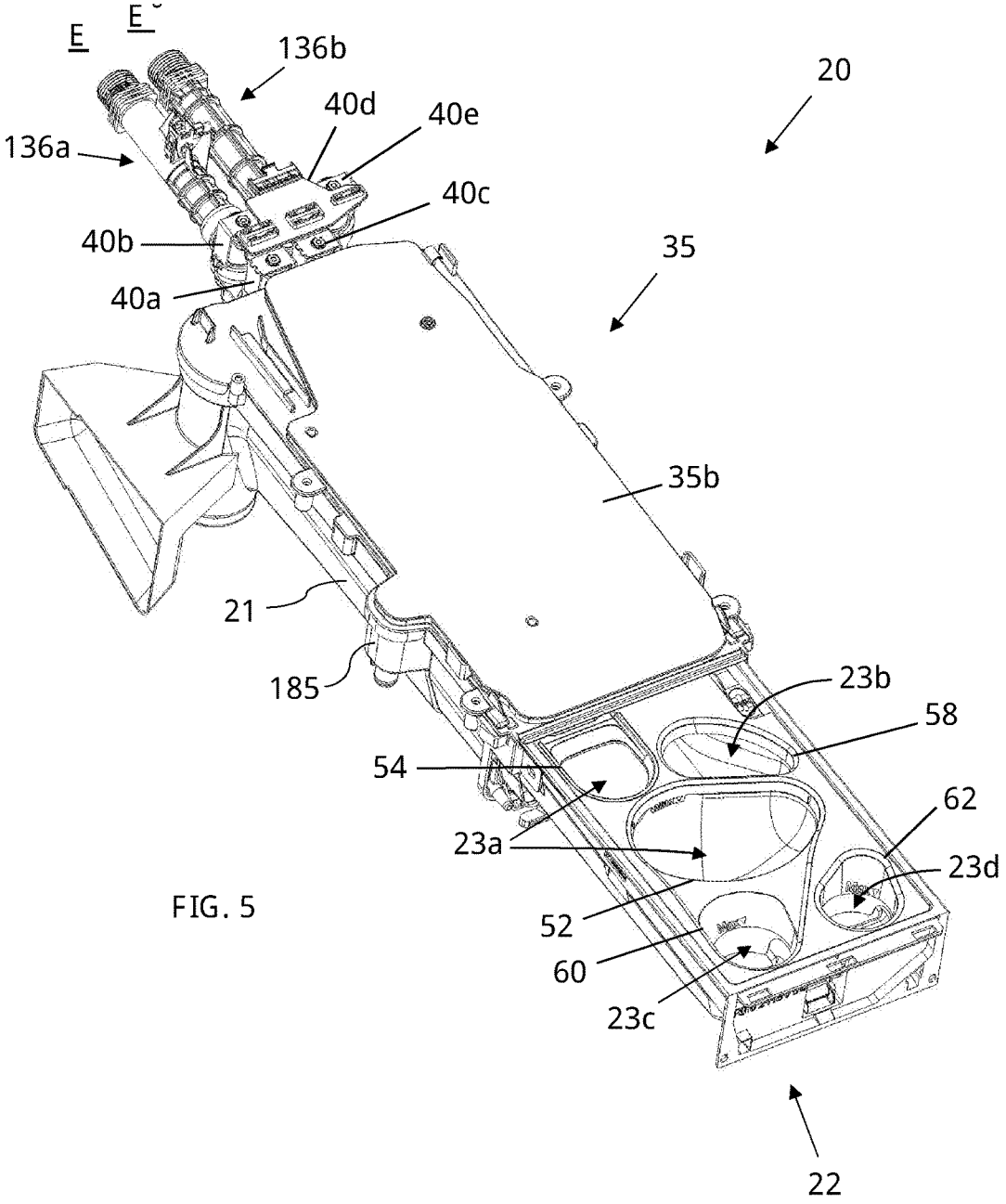
FIG. 5 is a perspective view of the treating agents dispenser, isolated from the rest, of the laundry washing machine represented in FIG. 3 with the drawer in its opened position.
Figure 6:
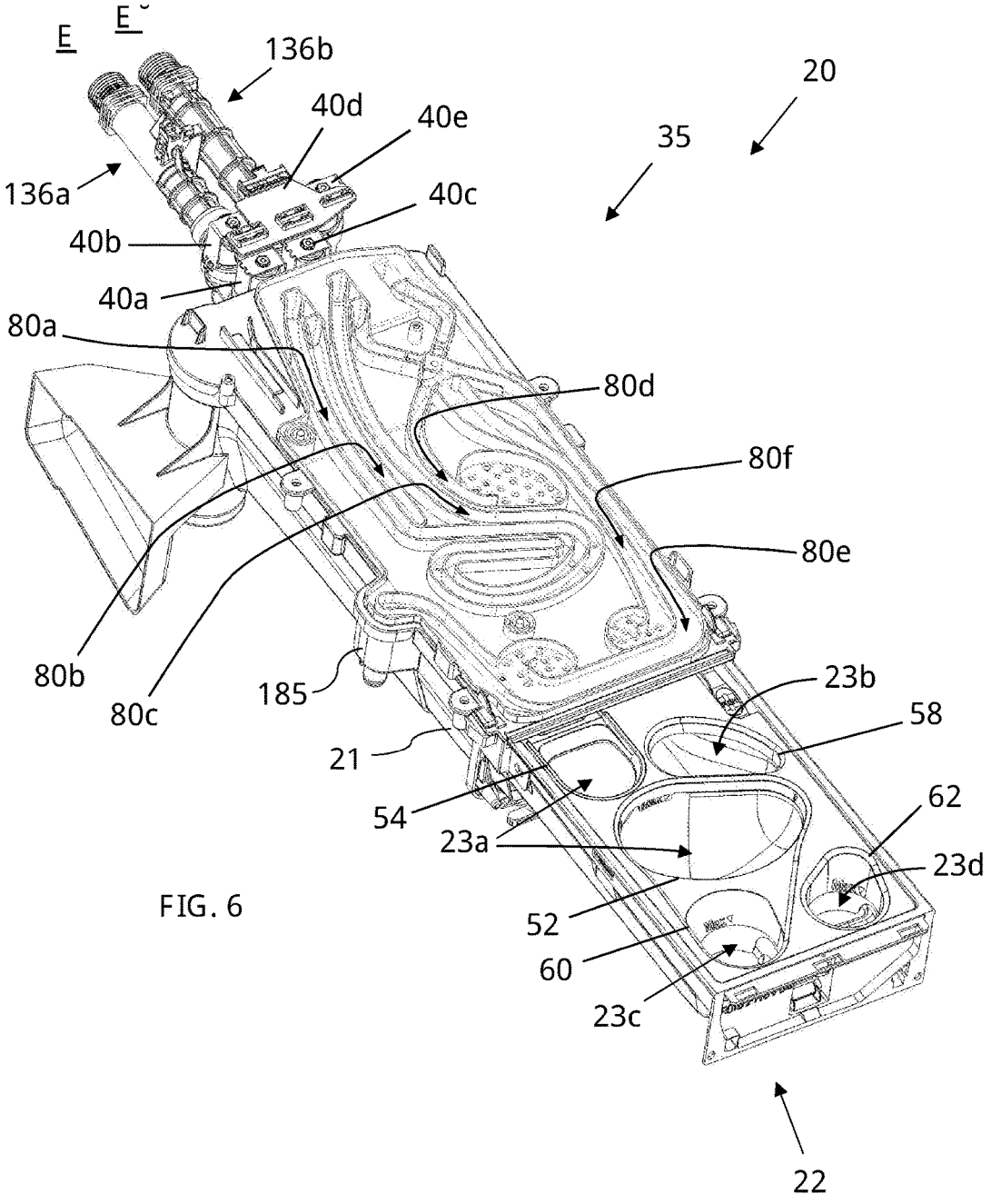
FIG. 6 shows the treating agents dispenser of FIG. 5 with an element removed therefrom.

The third aperture 56 is preferably not accessible for the user, as illustrated for example in FIGS. 4, 5 and 6 where the drawer 22 is in its totally opened position and the third aperture 56 does not protrude and is not visible and not accessible for the user.

Advantageously, the user may fill the first compartment 23*a* through the first aperture 52 with powder detergent and/or may insert a pod in the first compartment 23*a* through the second aperture 54.

The two apertures 52, 54 above the first compartment 23*a* advantageously define respective correct positions where the powder detergent or the pod may be placed by the user inside the first compartment 23*a*.

In particular, the first aperture 52 preferably defines positioning of the powder detergent centrally in the first compartment 23*a* and the second aperture 54 advantageously defines positioning of the pod rearward in the first compartment 23*a*.

Said positions defined by the first aperture 52 and/or the second aperture 54 preferably correspond to the best positions for the powder detergent or the pod along the direction of the water falling into the first compartment 23*a* from outlets/openings 82*a*, 82*b*, 82*c* of the distributor 35.

Correct positioning of the powder detergent or of the pod in the first compartment 23*a* assure that all, or almost all, the treating agent (detergent) is drawn through the aperture 26 into the washing tub 3 by the water falling down from the distributor 35.

Advantageously, no products accumulate at side walls of the first compartment 23*a*. This guarantees good hygienic conditions inside the first compartment 23*a*, in particular when the laundry washing machine 1 is not used for a long time between two successive washing cycles.

The fourth aperture 58 is preferably used to introduce a powder stain remover which is used during a proper phase of the selected washing cycle.

Advantageously, the user may fill the second compartment 23*b* through the fourth aperture 58.

The fifth aperture 60 is preferably used to introduce a liquid sanitization additive, for example bleach, which is which is used during a proper phase of the selected washing cycle.

Advantageously, the user may fill the third compartment 23*c* through the fifth aperture 60.

The sixth aperture 62 is preferably used to introduce a liquid softener, which is used during a proper phase of the selected washing cycle.

Advantageously, the user may fill the fourth compartment 23*d* through the sixth aperture 62.

The underside of the cover element 50, as illustrated in FIG. 7, preferably comprises a first siphon cap 90 and a second siphon cap, not visible. The first siphon cap 90 is positioned over the siphon tube 24*c* of the third compartment 23*c* when the cover element 50 is arranged over the drawer 22. The second siphon cap is positioned over the siphon tube 24*d* of the fourth compartment 23*d* when the cover element 50 is arranged over the drawer 22.

Preferably, the water distributor 35 comprises five inlets 36*a*, 36*b*, 36*c*, 36*d*, 36*e* connectable through inlet ducts 136*a*, 136*b* to a hot water source E and to a cold water source E' which could comprise, for example, the plumbing of the building in which the laundry washing machine 1 is installed.

Preferably, the first and the second inlets 36*a*, 36*b* can be connected to the hot water source E through the first inlet duct 136*a* via respective first and second controllable valves 40*a*, 40*b*, preferably of the electromagnetic type, opportunely controlled by the control unit.

Preferably, the third, the fourth and the fifth inlets 36*c*, 36*d*, 36*e* can be connected to the cold water source E' through the second inlet duct 136*b* via respective third, fourth and fifth controllable valves 40*c*, 40*d*, 40*e* preferably of the electromagnetic type, opportunely controlled by the control unit.

Therefore, each of the five inlets 36*a*, 36*b*, 36*c*, 36*d*, 36*e* is opportunely fed with water, hot or cold, by activating the respective valve 40*a*, 40*b*, 40*c*, 40*d*, 40*e*.

Proper activation of one or more of said five valves 40*a*, 40*b*, 40*c*, 40*d*, 40*e* causes flowing of water to one of said water conveying lines 80*a*, 80*b*, 80*c*, 80*d*, 80*e*, 80*f*, as described in more detail later.

Figure 14:
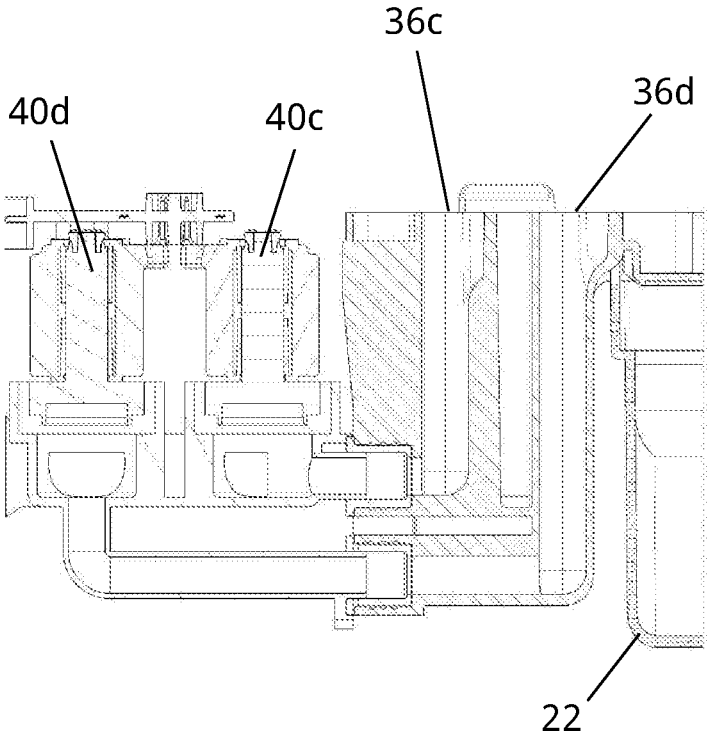
FIG. 14 is a plan sectional view taken along line XIV-XIV of FIG. 13.

FIG. 14 illustrates the connection between the third and fourth inlets 36*c*, 36*d* and respective third and fourth controllable valves 40*c*, 40*d*. Analogously, first and second inlets 36*a*, 36*b* are connected to the respective first and second controllable valves 40*a*, 40*b*.

Water conveying lines 80*a*, 80*b*, 80*c*, 80*d*, 80*e*, 80*f* are opportunely shaped so as to fluidly communicate with a different region 25*a*, 25*b*, 25*c*, 25*d* of the water distributor 35 and, finally, adapted for conveying water to one or more of said compartments 23*a*, 23*b*, 23*c*, 23*d* through outlets/openings 82*a*, 82*b*, 82*c*, 82*d*, 82*e*, 82*f*.

Each region 25*a*, 25*b*, 25*c*, 25*d* is opportunely displaced in such a way to be placed above a respective compartment 23*a*, 23*b*, 23*c*, 23*d* of the drawer 22 when the latter is placed in its closed position.

In particular, the first water conveying line 80*a* preferably supplies with hot water the outlets 82*a* of the first region 25*a* of the water distributor 35 which is positioned above the first compartment 23*a*.

Hot water is conveyed to the first compartment 23*a* of the drawer 22 by activating the first valve 40*a* and making the hot water flowing through the first water conveying line 80*a* up to the first region 25*a* and outlets 82*a*.

More in particular, the first water conveying line 80*a* supplies with hot water the outlets 82*a* of the first region 25*a* of the water distributor 35 which is positioned above the first aperture 52 of the cover element 50 associated to the first compartment 23*a*.

Outlets 82*a* are preferably linearly arranged along the first water conveying line 80*a* so that they are properly distributed over the first compartment 23*a*.

The first water conveying line 80*a* is exclusively provided with said outlets 82*a*, i.e.

without any other openings than said outlets 82*a*. In other words, this path is without cross-linkage to other water distributor lines therebetween.

Advantageously, the hot water from the first controllable valve 40*a* flows to the outlets 82*a* through a water tight path.

Advantageously, the water pressure is maintained from the hot water source E to the outlets 82*a*.

This guarantees high level of silentness when the hot water flows.

According to an advantageous aspect of the invention, also cold water may be preferably conveyed to the first compartment 23*a* of the drawer 22 by activating the third valve 40*c* and making the cold water flowing through the third water conveying line 80*c* up to the first region 25*a* and openings 82*c*.

More in particular, the third water conveying line 80*c* supplies with cold water the openings 82*c* of the first region 25*a* of the water distributor 35 which is positioned above the first aperture 52 of the cover element 50 associated to the first compartment 23*a*.

Openings 82*c* are preferably linearly arranged along the third water conveying line 80*c* so that they are properly distributed over the first compartment 23*a*.

The third water conveying line 80*c* is exclusively provided with said openings 82*c*, i.e. without any other openings than said openings 82*c*. In other words, this path is without cross-linkage to other water distributor lines therebetween.

Advantageously, the cold water from the third controllable valve 40*c* flows to the openings 82*c* through a water tight path.

Advantageously, the water pressure is maintained from the cold water source E' to the openings 82*c*.

This guarantees high level of silentness when the cold water flows.

According to an advantageous aspect, therefore, the treating agents dispenser 20 of the invention allows conveyance of hot and/or cold water to the same compartment 23*a* of the drawer 22 which receives a particular treating agent.

Preferably, conveyance of hot or cold water is carried out by means of activation of a respective valve 40*a*, 40*c*.

Preferably, the treating agents dispenser 20 of the invention allows conveyance of hot and/or cold water to the first compartment 23*a* of the drawer 22 which receives detergent used in the main washing phase of the selected washing cycle.

Advantageously, the treating agents dispenser 20 of the invention allows to optimize the use of the external water sources E, E' and/or to optimize the washing cycle selected by the user by conveying the proper amount of hot and/or cold water to the first compartment 23*a* of the drawer 22.

The second water conveying line 80*b* supplies with hot water the outlets 82*b* of the first region 25*a* of the water distributor 35 which is positioned above the first compartment 23*a*.

Hot water is conveyed to the first compartment 23*a* of the drawer 22 by activating the second valve 40*b* and making the hot water flowing through the second water conveying line 80*b* up to the first region 25*a* and outlets 82*b*.

More in particular, the second water conveying line 80*b* supplies with hot water the outlets 82*b* of the first region 25*a* of the water distributor 35 which is positioned above the second and the third apertures 54, 56 of the cover element 50 associated to the first compartment 23*a*.

Outlets 82*b* of the second water conveying line 80*b* are preferably constituted of nozzles 41, 42 and 43 adapted to generate water jets directed into the first compartment 23*a* which receives the detergent pod, preferably in correspondence of the second and third apertures 54, 56 of the cover element 50. The water jets are suited to hit a detergent pod which is positioned in the first compartment 23*a* and to break/perforate/cut its water-soluble pouch.

For simplicity's sake, hereinafter we will use the sole term "break" to indicate the action of perforating or cutting the water-soluble pouch of the detergent pod. The action of breaking or perforating or cutting the water-soluble pouch has to be intended as an action of breaking the water-soluble pouch by a mechanical action of the water jet and not exclusively by dissolution of the water-soluble pouch in contact with water.

Nozzles 41, 42 and 43 generate at its outputs the water jets with the required direction to hit the pod. Furthermore, the shape of the nozzles 41, 42 and 43 guarantees that the water jets are laminar-flow water jets.

As a result, the water jet doesn't spread out and every part of the flow travels in a substantially straight line.

With laminar-flow water jet it has to be intended that the water is ejected from the nozzle in a coherent stream. The coherent stream substantially maintains its shape from the nozzle to the target, in the present case the target is the detergent pod.

The laminar-flow water jet, therefore, is a flow which substantially maintains its shape (or cross section) throughout its extension.

The shape of the stream is determined by the shape of the nozzle or, in other words, the nozzle is shaped to produce a stream that is of a particular shape.

In particular, two water jets are generated by the first and second nozzles 41, 42 and pass through the second aperture 54 of the cover element 50 and the third water jet is generated by the third nozzle 43 and pass through the third aperture 56 of the cover element 50.

When the detergent pod is received in the first compartment 23*a*, the water jets pass through the second and third aperture 54, 56 and hit the water-soluble pouch of the detergent pod and break it.

The second water conveying line 80*b* is exclusively provided with said nozzles 41, 42, 43, i.e. without any other openings than said nozzles 41, 42, 43.

Advantageously, the hot water from the second controllable valve 40*b* flows to the nozzles 41, 42, 43 through a water tight path.

Advantageously, the water pressure is maintained from the hot water source E to the nozzles 41, 42, 43.

This guarantees high level of silentness when the hot water flows.

According to an advantageous aspect, therefore, the treating agents dispenser 20 of the invention comprises a further water conveying line 80*b* provided with one or more nozzles 41, 42 and 43 adapted to generate one or more water jets directed into the compartment 23*a* which receives a detergent pod, wherein the water jets are suited to hit the detergent pod and to break its water-soluble pouch.

In the preferred embodiment illustrated, hot water is preferably conveyed through the further water conveying line 80*b* by activating the second valve 40*b*. In further preferred embodiments, the further water conveying line provided with one or more nozzles adapted to generate one or more water jets are preferably connected a cold water source.

The fourth water conveying line 80*d* supplies with cold water the outlets 82*d* of the second region 25*b* of the water distributor 35 which is positioned above the second compartment 23*b*.

Cold water is conveyed to the second compartment 23*b* of the drawer 22 by activating the fifth valve 40*e* and making the cold water flowing through the fourth water conveying line 80*d* up to the second region 25*b* and outlets 82*d*.

More in particular, the fourth water conveying line 80*d* supplies with cold water the outlets 82*d* of the second region 25*b* of the water distributor 35 which is positioned above the fourth aperture 58 of the cover element 50 associated to the second compartment 23*b*.

Outlets 82*d* are preferably homogenously arranged in the second region 25*b* so that they are properly distributed over the second compartment 23*b*.

Figure 12:
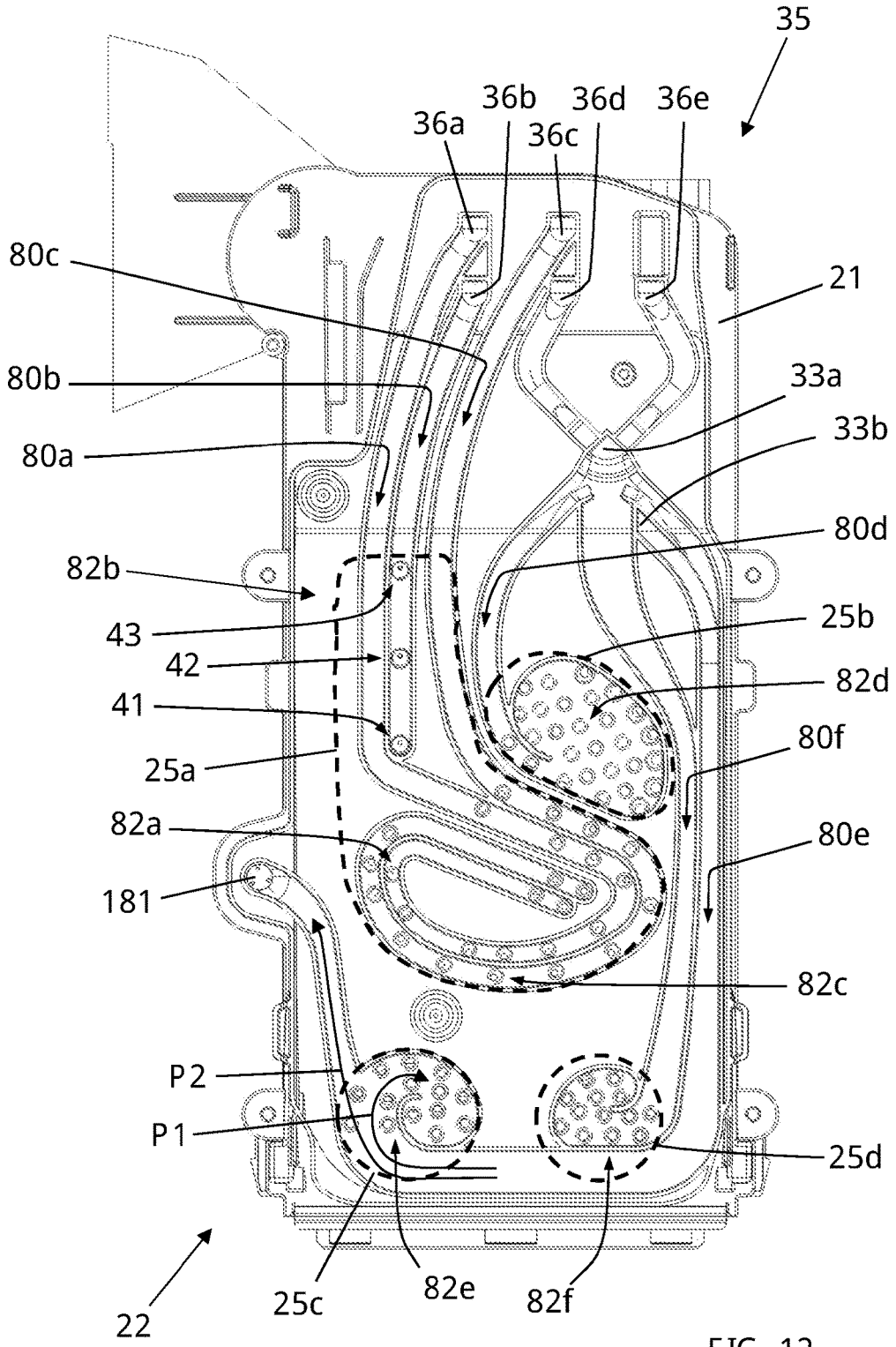
FIG. 12 is a plan view of the treating agents dispenser of FIG. 6 with the drawer in its closed position and some components removed therefrom.
Figure 12A:
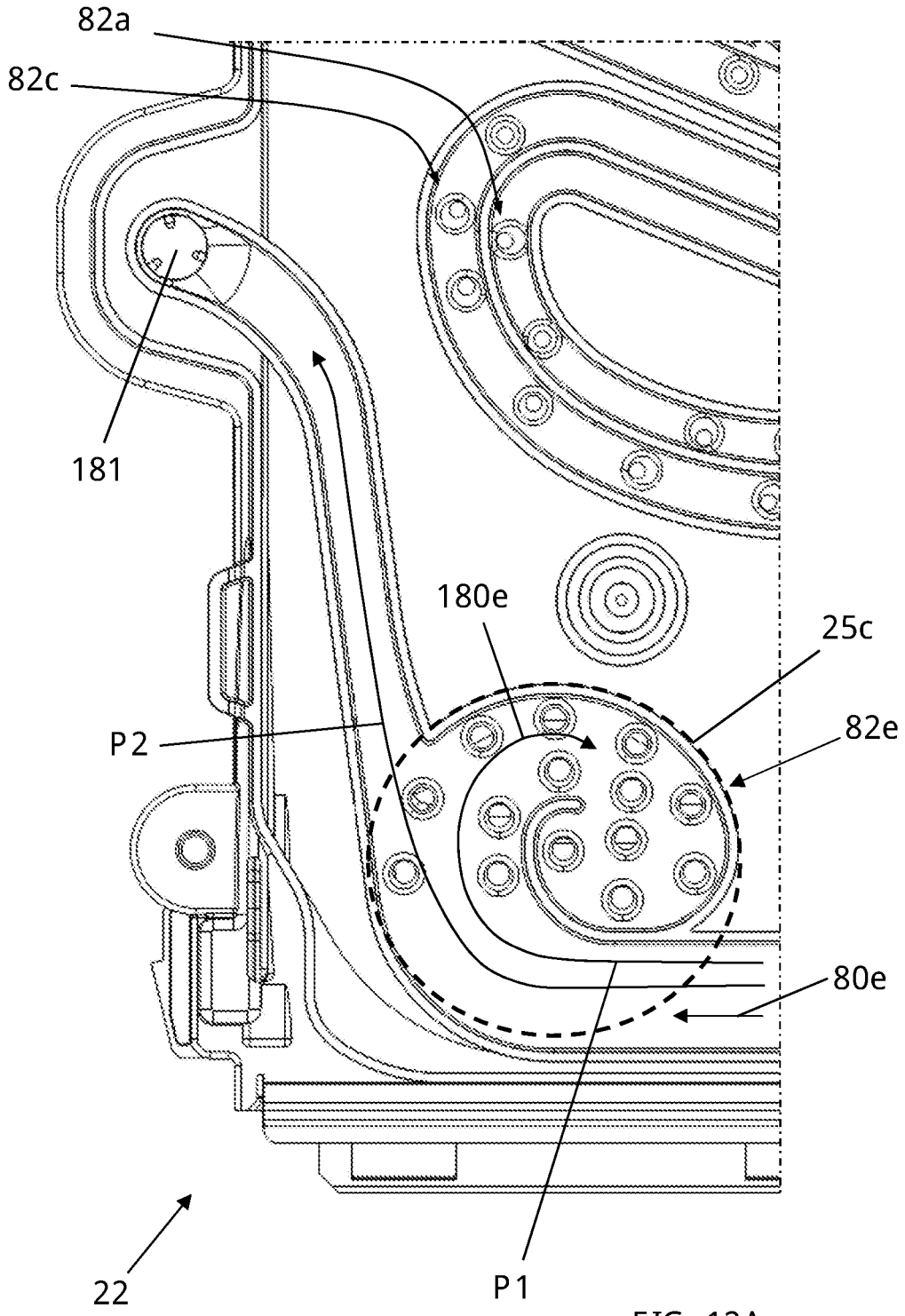
FIG. 12A shows an enlarged view of a detail of FIG. 12.
Figure 13:
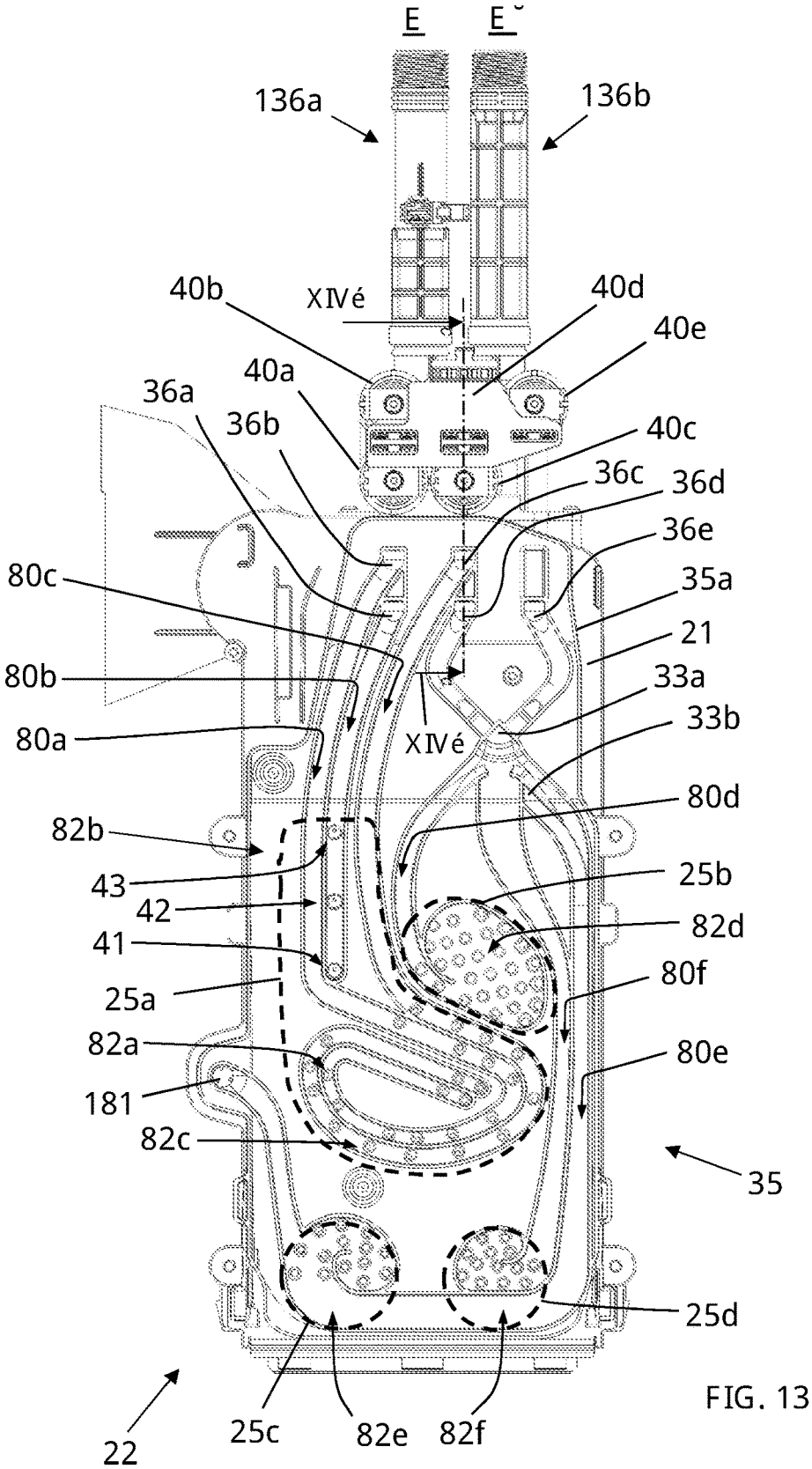
FIG. 13 is a plan view of the treating agents dispenser of FIG. 5 with the drawer in its closed position.

According to an advantageous aspect of the invention, the fifth water conveying line 80*e* comprises a first path, indicated with P1 in FIGS. 12 and 12A, which supplies with cold water the outlets 82*e* of the third region 25*c* of the water distributor 35 and a second path, indicated with P2, provided with at least one water outlet 181 which allows the water to be conveyed to the tub 3 bypassing the compartments 23*a*, 23*b*, 23*c*, 23*d*.

In the preferred embodiment illustrated in the figures, the second path P2 is provided with just one water outlet 181. In further preferred embodiments, a plurality of outlets may be provided.

The first path P1 preferably diverges from the second path P2 upstream of said at least one water outlet 181.

Preferably, the outlet 181 is placed above the drawer 22 in such a way to be outside the cover element 50 and outside the compartments 23*a*, 23*b*, 23*c*, 23*d*.

Preferably, the outlet 181 is placed above a water receiving seat 185 of the housing 21.

The water receiving seat 185 is then preferably provided with a pipe, not shown, which conveys water into the tub 3 which then enter the drum 4. In a preferred embodiment, the pipe terminates at the bellows of the door 8.

In a further preferred embodiment, the pipe terminates directly at a surface of the tub. In general, water coming from outlet 181 of the second path P2 is advantageously conveyed to the tub/drum by means of tubes/pipes, or equivalent means, opportunely arranged inside the casing.

Advantageously, cold water flowing through the fifth water conveying line 80*e* may reach the terminal outlet 181 through the second path P2 and may reach the tub 3 without entering the compartments 23*a*, 23*b*, 23*c*, 23*d* of the treating agents dispenser 20.

Advantageously, during the washing cycle clean cold water may be conveyed into the tub 3 by activating the fourth valve 40*d* and making the cold water flowing through the fifth water conveying line 80*e* up to the terminal outlet 181 through the second path P2.

Also, preferably, cold water is conveyed to the third compartment 23*c* of the drawer 22 by activating the fourth valve 40*d* and making the cold water flowing through the fifth water conveying line 80*e* and the first path P1 up to the third region 25*c* and outlets 82*e*.

More in particular, the fifth water conveying line 80*e* supplies with cold water the outlets 82*e* of the third region 25*c* of the water distributor 35 which is positioned above the fifth aperture 60 of the cover element 50 associated to the third compartment 23*c*.

Outlets 82*e* are preferably distributed along the first path P1 and arranged in the third region 25*c* so that they are properly distributed over the third compartment 23*c*.

The first path P1 comprises a curved portion 180*e*, preferably a dead-end portion and more preferably a spiral-shaped portion, and outlets 82*e* are preferably homogenously arranged in said curved portion 180*e*.

Advantageously, water moves in a curved course, more preferably in a spiral course, along the first path P1.

Advantageously, the flow of the water along the first path P1 that circulates above outlets 82*e* has reduced turbulence. This enhances homogenously distribution of water over the outlets 82*e* and hence the flowing of water through outlets 82*e* and respective flow rate.

Advantageously, by providing the fifth water conveying line 80*e* with a first path P1 with outlets 82*e* and a second path P2 with at least one water outlet 181 it is possible to maintain the water pressure inside the water conveying line 80*e* at low reasonable values that reduces mechanical stresses which may affect the same water conveying line 80*e*. The failure rate is therefore also advantageously reduced. As can be seen in FIG. 6, paths P1 and P2 share a common path portion.

The sixth water conveying line 80*f* supplies with cold water the outlets 82*f* of the fourth region 25*d* of the water distributor 35 which is positioned above the fourth compartment 23*d*.

Cold water is conveyed to the fourth compartment 23*d* of the drawer 22 by activating both the fourth and the fifth valves 40*d*, 40*e* and making the cold water flowing through the sixth water conveying line 80*f* up to the fourth region 25*d* and outlets 82*f*.

In particular, the water flowing through the sixth water conveying line 80*f* is the combination of the colliding flows coming from the fourth and fifth inlets 36*d*, 36*e* with the fourth and the fifth valves 40*d*, 40*e* activated.

More in particular, the sixth water conveying line 80*f* supplies with cold water the outlets 82*f* of the fourth region 25*d* of the water distributor 35 which is positioned above the sixth aperture 62 of the cover element 50 associated to the fourth compartment 23*d*.

Outlets 82*f* are preferably homogenously arranged in the fourth region 25*d* so that they are properly distributed over the fourth compartment 23*d*.

The water distributor 35 is also further preferably provided with two apertures 33*a*, 33*b* which are placed above the drawer 22 in such a way to allow the flowing of water directly to the bottom 21*a* of the housing 21 and outside the compartments 23*a*, 23*b*, 23*c*, 23*d*, 23*e*, 23*f* without entering the compartments 23*a*, 23*b*, 23*c*, 23*d*, 23*e*, 23*f*.

The apertures 33*a*, 33*b* are preferably realized in the lower part 35*a* of the water distributor 35.

The first aperture 33*a* allows the flowing of exceeding water (overflow) of the water conveying lines 80*d*, 80*e*, 80*f* and the second aperture 33*b* allows the flowing of exceeding water (overflow) of the fifth water conveying line 80*e*.

While in the preferred embodiment illustrated the drawer comprises four compartments, it has to be underlined that in different embodiments the number of compartments may be different, even just one.

It has to be understood that also the shape of the compartments may be any shape suitable to receive a treating agent therewith or also to receive an auxiliary stand-alone liquid detergent container.

It has thus been shown that aspects of the present invention allow various of the set objects to be achieved. In particular, it makes it possible to realize a laundry washing machine that is able to guarantee a good distribution of water to the compartments.

It is underlined that the laundry washing machines illustrated in the enclosed figures are of the front-loading type; however it is clear that the system according to the invention can be applied as well to a top-loading laundry washing machine, substantially without modification.

While the present invention has been described with reference to the particular embodiment shown in the figures, it should be noted that the present invention is not limited to the specific embodiment illustrated and described herein; on the contrary, further variants of the embodiment described herein fall within the scope of the present invention, which is defined in the claims.

The invention claimed is:

1. A laundry washing machine connectable to an external water source comprising a cabinet supporting a washing tub enclosing a rotatable washing drum suited to receive laundry and a treating agents dispenser connectable to the external water source and fluidly connected to the washing tub, the treating agents dispenser comprising:

a drawer comprising at least one open-top compartment for receiving at least one agent for treating laundry;

a supporting structure on which the drawer can slide so that it can be positioned in a closed position and an opened position; and a water distributor arranged above the drawer, the water distributor comprising a water conveying line for conveying water from the external water source to the washing tub and to a region of the water distributor which is positioned above the at least one compartment when the drawer is in its closed position;

wherein the water conveying line comprises a first path which supplies water to one or more first outlets arranged in said region of the water distributor positioned above the at least one compartment and a second path which supplies water to one or more second outlets suited to convey water to the tub/drum and bypass the first outlets of the compartment in said region, and wherein a common path portion of the conveying line is fluidly shared by said first path and said second path of the same conveying line.

2. A machine according to claim 1, wherein the first path diverges from the second path upstream of said one or more second outlets.

3. A machine according to claim 1, wherein the first path comprises a curved portion.

4. A machine according to claim 3, wherein the curved portion comprises a dead-end portion.

5. A machine according to claim 3, wherein the curved portion is spiral-shaped portion.

6. A machine according to claim 3, wherein said first outlets are homogenously arranged in the curved portion.

7. A machine according to claim 1, wherein said second outlets are arranged above the drawer in such a way to be outside the at least one compartment.

8. A machine according to claim 1, wherein said second outlets are arranged above a water receiving seat of a housing for the supporting structure.

9. A machine according to claim 1, further comprising a pipe fluidly connecting the water receiving seat to the tub.

10. A machine according to claim 9, wherein the pipe terminates at a bellows of a door of the machine, or at a surface of the tub.

11. A machine according to claim 1, wherein the external water source comprises a cold external water source.

12. A machine according to claim 1, wherein the at least one compartment comprise a compartment that is configured to receive a liquid bleach.

13. A machine according to claim 1, further comprising a valve arranged between a connection to the external water source and the at least one water conveying line.

14. A laundry washing machine connectable to an external hot water source and to an external cold water source, the machine comprising a cabinet supporting a washing tub enclosing a rotatable washing drum suited to receive laundry and a treating agents dispenser connectable to the external water sources and fluidly connected to the washing tub, the treating agents dispenser comprising:

a drawer comprising an open-top compartment for receiving at least one agent for treating laundry;

a supporting structure on which the drawer can slide so that it can be positioned in a closed position and an opened position; and a water distributor arranged above the drawer, wherein the water distributor comprises a first region which is positioned above the at least one compartment when the drawer is in its closed position and wherein the water distributor comprises a first water conveying line having an outlet arranged in the first region for conveying hot water from the external hot water source to the outlet and then to the compartment when the drawer is in its closed position, said first water conveying line extending from a hot water source connection to said outlet without cross-linkage to other water distributor lines therebetween, and a second water conveying line having an opening to the washing tub and arranged in the first region for both conveying cold water from the external cold water source to the opening to the washing tub and then to the compartment when the drawer is in its closed position, said second water conveying line extending from a cold water source connection to said opening to the washing tub without cross-linkage to other water distributor lines therebetween, wherein the second water conveying line has a fluidly shared common path portion, wherein the water conveyed from the second water conveying line in a first path of the common path portion is supplied to the compartment, and the water conveyed in a second path of the common path portion is supplied to the washing tub and bypasses the compartment.

15. A machine according to claim 14, further comprising a first valve arranged between the connection to the external hot water source and the first water conveying line and a second valve arranged between the connection to the external cold water source and the second water conveying line.

16. A machine according to claim 15, wherein the first water conveying line comprises a water tight path fluidly connecting said first valve and said at least one outlet and/or the second water conveying line comprises a water tight path fluidly connecting said second valve and said at least one opening.

17. A machine according to claim 14, wherein the at least one compartment is suited to receive a detergent for a main wash phase.

18. A machine according to claim 14, wherein the compartment is suited to receive a unit dose package comprising a pre-measured amount of treating agent incorporated into a water-soluble pouch and wherein the water distributor comprises a further water conveying line having at least one nozzle arranged in the first region, the further water conveying line being suited for conveying hot or cold water from one of the external sources to the at least one nozzle for generating at least one water jet into the at least one compartment so that the at least one water jet is suited to hit the unit dose package and break the water-soluble pouch when the drawer is in its closed position.

19. A machine according to claim 18, further comprising a valve arranged between a connection to the external hot or cold water source and the further water conveying line.

20. A machine according to claim 18, wherein said at least one nozzle is configured to generate a laminar-flow water jet.

21. A machine according to claim 18, wherein the further water conveying line comprises a water tight path fluidly connecting said valve and said at least one nozzle.

22. A machine according to claim 18, wherein the at least one compartment further comprises a stopping device adapted for stopping the unit dose package in a predefined zone inside the at least one compartment.

23. A machine according to claim 22, wherein the stopping device is configured to stop the unit dose package when the unit dose package is intact, and to allow passage of treating agent released from the unit dose package after breakage of the water-soluble pouch.

* * * * *